US010969724B2

(12) United States Patent
Ohta et al.

(10) Patent No.: US 10,969,724 B2
(45) Date of Patent: Apr. 6, 2021

(54) INFORMATION PROCESSING APPARATUS THAT ENABLES COMMUNICATION WITH IMAGE FORMING APPARATUS THAT HAS CONSUMABLE AND CONTROL METHOD FOR IMAGE FORMING APPARATUS THAT HAS CONSUMABLE

(71) Applicant: CANON KABUSHIKI KAISHA, Tokyo (JP)

(72) Inventors: Yuya Ohta, Abiko (JP); Takuya Hayakawa, Koshigaya (JP); Kiyoharu Kakomura, Nagareyama (JP); Seita Inoue, Kashiwa (JP); Naoka Omura, Matsudo (JP); Shunsuke Nishimura, Tokyo (JP); Yuichi Yamamoto, Nagareyama (JP); Satoru Kojima, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/715,277

(22) Filed: Dec. 16, 2019

(65) Prior Publication Data

US 2020/0201230 A1 Jun. 25, 2020

(30) Foreign Application Priority Data

Dec. 21, 2018 (JP) ..... JP2018-239880

(51) Int. Cl.
*G03G 15/08* (2006.01)
*G03G 15/00* (2006.01)

(52) U.S. Cl.
CPC ..... *G03G 15/556* (2013.01)

(58) Field of Classification Search
CPC ..... G03G 15/556
USPC ..... 399/27
See application file for complete search history.

(56) References Cited

U.S. PATENT DOCUMENTS 9,354,578 B2 * 5/2016 Yeh ..... G03G 15/556
10,627,765 B2 * 4/2020 Miyazawa ..... G03G 15/556

FOREIGN PATENT DOCUMENTS

JP 2017-037596 A 2/2017

OTHER PUBLICATIONS

Co-pending U.S. Appl. No. 16/847,291, filed Apr. 13, 2020.
Co-pending U.S. Appl. No. 16/847,303, filed Apr. 13, 2020.

* cited by examiner

*Primary Examiner* — William J Royer
(74) *Attorney, Agent, or Firm* — Venable LLP

(57) ABSTRACT

Provided is a technology relating to an image forming apparatus configured to calculate a toner usage amount per day. The image forming apparatus stores the calculated toner usage amount per day in a list when a toner usage history is permitted to be stored, and avoids storing the calculated toner usage amount per day in the list when the usage history is inhibited from being stored. When the toner usage history is permitted to be stored, the image forming apparatus extracts a feature amount indicating a toner consumption tendency exhibited by a user based on the toner usage amount per day corresponding to a predetermined period stored in the list, and avoids extracting the feature amount when the toner usage history is inhibited from being stored.

6 Claims, 13 Drawing Sheets

| | | |
|---|---|---|
| AVERAGE OF TONER USAGE AMOUNT CORRESPONDING TO PAST 30 DAYS[g]: | $U_{AVE}$ | 17.4 |
| STANDARD DEVIATION OF TONER USAGE AMOUNT CORRESPONDING TO PAST 30 DAYS [g]: | $\sigma$ | 20.6 |
| REMAINING AMOUNT PREDICTION ERROR [g]: | $\sigma_L$ | 5 |
| REMAINING TONER AMOUNT [g]: | $W$ | 378.9 |
| DELAYED DELIVERY POSSIBILITY VARIABLE: | $r$ | 5 |

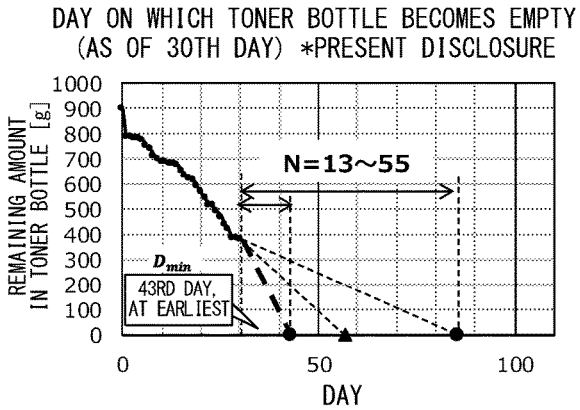

| | | |
|---|---|---|
| AVERAGE OF TONER USAGE AMOUNT CORRESPONDING TO PAST 30 DAYS[g]: | $U_{AVE}$ | 14.2 |
| STANDARD DEVIATION OF TONER USAGE AMOUNT CORRESPONDING TO PAST 30 DAYS [g]: | $\sigma$ | 10.8 |
| REMAINING AMOUNT PREDICTION ERROR[g]: | $\sigma_L$ | 5 |
| REMAINING TONER AMOUNT[g]: | $W$ | 378.9 |
| DELAYED DELIVERY POSSIBILITY VARIABLE: | $r$ | 5 |

FIG. 13A

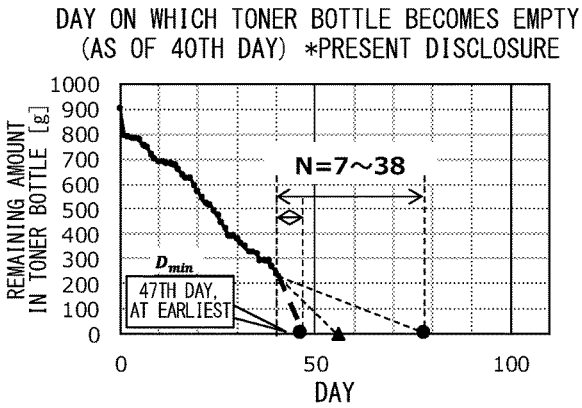

| | | |
|---|---|---|
| AVERAGE OF TONER USAGE AMOUNT CORRESPONDING TO PAST 30 DAYS[g]: | $U_{AVE}$ | 15.0 |
| STANDARD DEVIATION OF TONER USAGE AMOUNT CORRESPONDING TO PAST 30 DAYS [g]: | $\sigma$ | 10.7 |
| REMAINING AMOUNT PREDICTION ERROR[g]: | $\sigma_L$ | 5 |
| REMAINING TONER AMOUNT[g]: | $W$ | 238.6 |
| DELAYED DELIVERY POSSIBILITY VARIABLE: | $r$ | 5 |

FIG. 13B

INFORMATION PROCESSING APPARATUS THAT ENABLES COMMUNICATION WITH IMAGE FORMING APPARATUS THAT HAS CONSUMABLE AND CONTROL METHOD FOR IMAGE FORMING APPARATUS THAT HAS CONSUMABLE

BACKGROUND OF THE INVENTION

Field of the Invention

The present disclosure relates to a technology for managing consumables of an image forming apparatus.

Description of the Related Art

A maintenance system is built in order to manage consumables of an image forming apparatus. The maintenance system is configured by, for example, connecting the image forming apparatus and a maintenance server through a network such as the Internet. When detecting that the replacement timing of a consumable is approaching, the image forming apparatus notifies the maintenance server of a delivery request signal for requesting a delivery of a new consumable. In response to the delivery request signal, the maintenance server arranges the delivery of a new consumable to a workplace or other such place in which the image forming apparatus is installed. This allows a user to obtain a new consumable. At the time of the notification of the delivery request signal, the image forming apparatus informs the user that the replacement timing is approaching through a display. With this configuration, the usability is improved.

Consumables of the image forming apparatus refer to toner and other such consumables to be consumed by being used for a printed product, and a photosensitive member and other such consumables (consumable parts) configured to operate in order to generate a printed product. When the toner is exhausted while the image forming apparatus is being used, the image forming apparatus becomes unable to create such a printed product as expected by the user. Therefore, each of the consumables is required to be delivered to the user before being used up.

An image forming apparatus disclosed in Japanese Patent Application Laid-open No. 2017-037596 is configured to calculate the number of remaining days for which a toner bottle can be used by predicting a remaining toner amount from the user's usage history of a consumable (toner). The image forming apparatus notifies a maintenance server of a delivery request signal when the number of remaining days falls below a predetermined number of days. By notifying the maintenance server of the delivery request signal based on the calculated number of remaining days, it is possible to deliver the toner bottle at an appropriate timing even in, for example, a case in which a toner consumption rate differs depending on the user or a case in which the toner consumption rate varies.

The consumable may be used not only by a printing operation performed by the user (hereinafter referred to as "user printing operation") but also by an initial operation at the time of the replacement of the consumable, a maintenance operation, or other such sporadic operation of the image forming apparatus (hereinafter referred to as "non-user operation"). When the usage amount of the consumable used by the non-user operation is accumulated in the user's usage history, the user printing operation and the non-user operation coexist in the user's usage history. This causes a decrease in calculation accuracy of the number of remaining days.

For example, when toner is consumed by the initial operation at the time of the replacement of the consumable, the usage amount obtained by the initial operation is added to the usage amount obtained by the user printing operation, and the fact that a large amount of toner was consumed at the time of the replacement of the consumable is stored in the usage history. The toner usage amount based on the initial operation is generally larger than the toner usage amount obtained during the user printing operation. Therefore, the image forming apparatus determines that a large amount of toner is also expected to be used by future operations to cause the toner to be consumed quickly. The replacement of the consumable is an operation performed sporadically, and after the initial operation, toner is consumed only by the user printing operation. As a result, the image forming apparatus issues a notification of the delivery request signal even when the toner bottle contains sufficient toner in actuality.

In this manner, as a result of the decrease in calculation accuracy of the number of remaining days, the maintenance server is notified of the delivery request signal at an inappropriate timing. This may cause "early delivery", which is a phenomenon that a new consumable reaches the user while the remaining amount of the current consumable is sufficient, and "delayed delivery", which is an opposite phenomenon that the current consumable runs out before a new consumable reaches the user. The excessively "early delivery" has the risk of degrading the consumable by leaving the delivered consumable unattended by the user, or the risk of losing the consumable before actual replacement. The "delayed delivery" causes the image forming apparatus to become unusable due to the exhaustion of the consumable to stop the production of a printed product.

In order to deliver a consumable at an appropriate timing, it is required to estimate the number of remaining days as accurately as possible.

SUMMARY OF THE INVENTION

An information processing apparatus according to the present disclosure, which is communicable to/from an image forming device configured to form an image through use of a consumable, the information processing apparatus comprising: a controller configured to: acquire consumption data relating to a consumption amount of the consumable; generate, based on the consumption data, a model for determining a future change in remaining amount of the consumable; and determine, based on the model, information relating to a replacement timing at which the consumable is to be replaced, wherein the controller generates, in a case where the consumable has been replaced by another consumable, a model for determining a future change in the remaining amount of the another consumable without using consumption data relating to a timing at which the consumable was replaced by the another consumable.

Further features of the present invention will become apparent from the following description of exemplary embodiments (with reference to the attached drawings).

BRIEF DESCRIPTION OF THE DRAWINGS

FIG. 13A and FIG. 13B are each an explanatory graph and an explanatory table of the number of remaining days in at least one embodiment of the present disclosure.

DESCRIPTION OF THE EMBODIMENTS

Now, an image forming apparatus according to at least one embodiment of the present disclosure is described with reference to the drawings.

Configuration of Image Forming Apparatus

Figure 1:
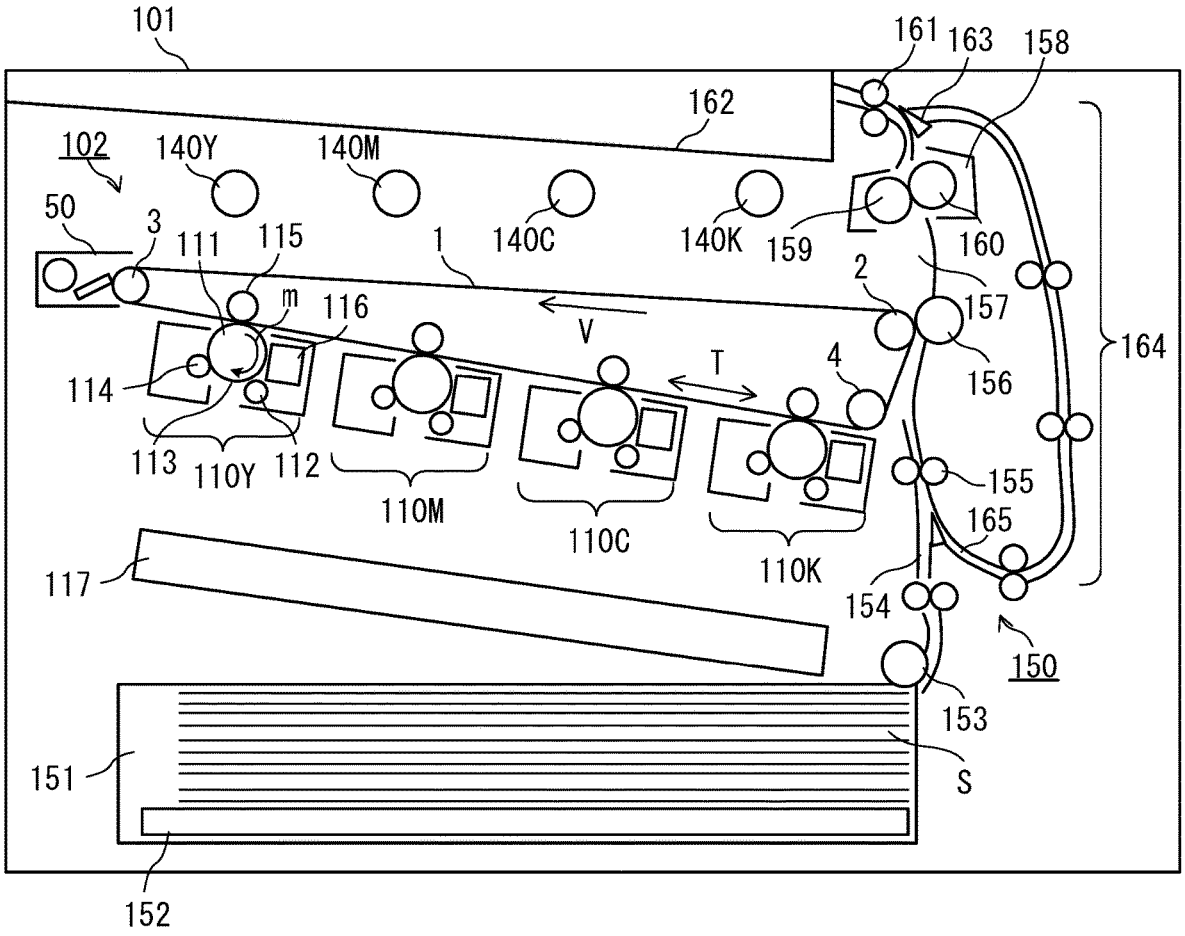
FIG. 1 is a configuration diagram of an image forming apparatus in at least one embodiment of the present disclosure.

FIG. 1 is a configuration diagram of an image forming apparatus in at least one embodiment of the present disclosure. An electrophotographic system, an offset printing system, and an ink jet system, and other such various systems can be applied to the image forming apparatus in at least one embodiment. The following description is directed to an image forming apparatus 101 using the electrophotographic system.

The image forming apparatus 101 employs an intermediate transfer tandem system, in which a plurality of image forming units 110Y, 110M, 110C, and 110K corresponding to four colors (yellow, magenta, cyan, and black) are arranged along an intermediate transfer belt 1. The symbols Y, M, C, and K at the end of the reference symbols represent yellow, magenta, cyan, and black, respectively. In the following description, the symbols Y, M, C, and K at the end of the reference symbols are omitted unless the description requires distinction between the colors. The image forming unit 110Y forms a yellow toner image. The image forming unit 110M forms a magenta toner image. The image forming unit 110C forms a cyan toner image. The image forming unit 110K forms a black toner image. The toner images of the respective colors are transferred from the image forming units 110Y, 110M, 110C, and 110K onto the intermediate transfer belt 1 so as to be superimposed one on another. The intermediate transfer belt 1 causes the toner images to be transferred onto a recording material S conveyed by a paper conveyor 150, to thereby form an image on the recording material S. The toner images transferred onto the recording material S are fixed to the recording material S by a fixing device 158.

The image forming units 110Y, 110M, 110C, and 110K are replenished with toners of corresponding colors from toner bottles 140Y, 140M, 140C, and 140K, respectively. The toner bottles 140Y, 140M, 140C, and 140K are removably attached to the image forming apparatus 101. The toner bottle 140Y contains yellow toner. The toner bottle 140M contains magenta toner. The toner bottle 140C contains cyan toner. The toner bottle 140K contains black toner. A replenishment port of each of the toner bottles 140Y, 140M, 140C, and 140K has its replenishment port shutter opened when the toner bottles 140Y, 140M, 140C, and 140K are each mounted to a bottle mount provided to the image forming apparatus 101. An operation for replenishing the toner from the toner bottle 140 is described later in detail.

Conveyance processing to be performed on the recording material S by the paper conveyor 150 is described. The recording materials S are received in a recording material receiver 151, and are stacked on a lift-up unit 152. The recording material S is fed from the recording material receiver 151 to a sheet feeding conveyance path 154 by a sheet feeding roller 153. The sheet feeding operation is started in accordance with an image forming timing for the image forming units 110Y, 110M, 110C, and 110K. The recording material S is conveyed along the sheet feeding conveyance path 154 to registration rollers 155. The registration rollers 155 correct the skew feed of the recording material S with respect to a conveyance direction, and adjust a timing to resume the conveyance to convey the recording material S to a secondary transfer portion. The secondary transfer portion is a transfer nip portion formed by a secondary transfer inner drive roller 2 and a secondary transfer outer drive roller 156, which are two transfer members arranged so as to be opposed to each other. The secondary transfer portion causes the toner images to be transferred from the intermediate transfer belt 1 onto the recording material S with a predetermined pressurizing force and a predetermined electrostatic load bias.

An image forming process for carrying the toner images to the secondary transfer portion in accordance with a timing at which the recording material S is conveyed to the secondary transfer portion is described. The image forming units 110Y, 110M, 110C, and 110K differ only in color of the toner image to be formed, and perform the same operation with the same configuration. The configuration and the operation of the image forming unit 110Y are described below. Descriptions of the other image forming units 110M, 110C, and 110K are omitted.

The image forming unit 110Y serving as a toner image forming unit includes a photosensitive member 111 being an image bearing member, a charging device 112, a developing device 114, a primary transfer roller 115, and a photosensitive member cleaner 116. In the vicinity of the image forming unit 110Y, a scanner unit 117 including a laser and a polygon mirror correction system lens are provided. The photosensitive member 111 has a drum shape, and is rotated in a direction indicated by the arrow m. The charging device 112 uniformly charges the surface of the photosensitive member 111 being rotated. The scanner unit 117 irradiates the charged surface (exposure portion 113) of the photosensitive member 111 with laser light modulated based on image pixel information (position or other such information on each of pixels forming the image) indicating an image to be formed. With this irradiation, an electrostatic latent image corresponding to the image pixel information is formed on the surface (exposure portion 113) of the photosensitive member 111. The developing device 114 develops the electrostatic latent image formed on the photosensitive member 111 with electrostatically charged yellow toner (developer). With this development, a yellow toner image is formed on the photosensitive member 111. In the same manner, a magenta toner image is formed on the photosensitive member of the image forming unit 110M. A cyan toner image is formed on the photosensitive member of the image forming unit 110C. A black toner image is formed on the photosensitive member of the image forming unit 110K.

The primary transfer roller 115 transfers a yellow toner image from the photosensitive member 111 onto the intermediate transfer belt 1 with a predetermined pressurizing force and a predetermined electrostatic load bias. Transfer residual toner remaining on the photosensitive member 111 after the transfer is collected by the photosensitive member cleaner 116. The photosensitive member 111 prepares for the subsequent image formation by collecting the transfer residual toner. In the same manner, the magenta toner image formed on the photosensitive member of the image forming unit 110M, the cyan toner image formed on the photosensitive member of the image forming unit 110C, and the black toner formed on the photosensitive member of the image forming unit 110K are sequentially transferred onto the intermediate transfer belt 1 so as to be superposed on the yellow toner image.

Such image forming processes for the respective colors as described above are performed in parallel by the image forming units 110Y, 110M, 110C, and 110K. The image forming processes are performed by the respective image forming units 110Y, 110M, 110C, and 110K at timings at which the toner images of the respective colors are sequentially transferred onto the intermediate transfer belt 1 so as to be superimposed one on another. As a result, a full-color toner image is finally formed on the intermediate transfer belt 1. The full-color toner image is carried to the secondary transfer portion by the intermediate transfer belt 1. In at least one embodiment, the configuration for forming the toner images of the four colors of yellow, magenta, cyan, and black has been described, but the number of colors is not limited thereto. In addition, the arrangement of the image forming units 110 is not limited to the configuration illustrated in FIG. 1.

The intermediate transfer belt 1 is included in an intermediate transfer belt unit 102. The intermediate transfer belt unit 102 includes the secondary transfer inner drive roller 2, a tension roller 3, and a pre-secondary-transfer roller 4, around which the intermediate transfer belt 1 is stretched. The secondary transfer inner drive roller 2 serves both as a drive member and as a secondary transfer inner member. The tension roller 3 applies a predetermined tensile force to the intermediate transfer belt 1. The pre-secondary-transfer roller 4 is a tension member. The intermediate transfer belt 1 is a belt member to be driven to be conveyed in a direction indicated by the arrow V by the secondary transfer inner drive roller 2. The intermediate transfer belt 1 is driven to be conveyed to carry the toner images transferred from the respective image forming units 110 to the secondary transfer portion.

With respect to the conveyance direction of the intermediate transfer belt 1 indicated by the arrow V, the pre-secondary-transfer roller 4 is arranged on an upstream side of the secondary transfer inner drive roller 2, while the tension roller 3 is on a downstream side of the secondary transfer inner drive roller 2. The primary transfer rollers 115 for the respective image forming units 110 are arranged between the tension roller 3 and the pre-secondary-transfer roller 4. The tension roller 3 and the pre-secondary-transfer roller 4 are not applied with a drive force, and are rotated by following the conveyance of the intermediate transfer belt 1.

The tension roller 3 is movable in a direction indicated by the arrow T (direction of the intermediate transfer belt 1 looped around the tension roller 3 and the pre-secondary-transfer roller 4). The tension roller 3 is urged in a direction for applying a tensile force to the intermediate transfer belt 1 by an urging portion (not shown). The secondary transfer inner drive roller 2 has its outer peripheral surface made of conductive ethylene-propylene-diene rubber (EPDM). With this configuration, the secondary transfer inner drive roller 2 can convey the intermediate transfer belt 1 by a friction force under a state in which the tension roller 3 is applying a tensile force to the intermediate transfer belt 1. An initial frictional resistance μ of the outer peripheral surface of the secondary transfer inner drive roller 2 is set to from about 1.0 to about 1.5. The material of the secondary transfer inner drive roller 2 and the initial frictional resistance of the outer peripheral surface are not limited to those of the above-mentioned configuration. An intermediate transfer cleaner 50 configured to remove toner remaining on the intermediate transfer belt 1 is fixedly mounted to the tension roller 3 at a position opposed to the tension roller 3 across the intermediate transfer belt 1.

In at least one embodiment, the intermediate transfer belt 1 is an endless belt made of polyimide and having a circumferential length of 792 mm, a width of 346 mm, and a thickness of 60 μm. The material of the intermediate transfer belt 1 is not limited thereto, and an endless belt made of, for example, polycarbonate, PVDF, ETFE, or PTFE can be used. In addition, the number of rollers around which the intermediate transfer belt 1 is looped is not limited to that of the configuration illustrated in FIG. 1.

With such a configuration as described above, the recording material S is conveyed and the toner image is carried to the secondary transfer portion. The secondary transfer portion secondarily transfers the full-color toner image formed on the intermediate transfer belt 1 onto the recording material S. The recording material S onto which the toner image has been transferred is conveyed from the secondary transfer portion to the fixing device 158 through a pre-fixing conveyor 157.

The fixing device 158 has various configurations and systems. In at least one embodiment, the fixing device 158 includes a fixing roller 159 and a pressure roller 160, which are arranged so as to be opposed to each other. The fixing device 158 melts and fixes the toner image to the recording material S by applying a predetermined pressurizing force and a predetermined amount of heat to the recording material S within a fixing nip formed by the fixing roller 159 and the pressure roller 160. The fixing roller 159 internally includes a heater serving as a heat source. The pressure roller 160 is urged against the fixing roller 159.

The recording material S to which the image has been fixed is conveyed from the fixing device 158 to sheet delivery reversal rollers 161 or a duplex conveyance path 164 by a flapper 163. When the recording material S is to be delivered to a sheet delivery tray 162, the flapper 163 conveys the recording material S to the sheet delivery reversal rollers 161. When images are to be formed on both sides (double-sided printing), the flapper 163 temporarily conveys the recording material S to the sheet delivery reversal rollers 161. After that, the sheet delivery reversal rollers 161 switch the leading end and the trailing end of the recording material S by performing a switch-back operation. Meanwhile, the flapper 163 is switched over, and guides the recording material S, which has the leading end and the trailing end switched, to the duplex conveyance path 164.

After that, the recording material S joins into the sheet feeding conveyance path 154 from a re-feed path 165 in synchronization with a recording material S of the subsequent job conveyed from the sheet feeding roller 153, and an image is formed on the back side (second surface) of the recording material S. The recording material S is conveyed and the toner image is carried to the secondary transfer portion in the same manner as in the front side (first surface). The image forming process is performed on the back side (second surface) in the same manner as in the above-mentioned case of the front side (first surface).

Toner Replenishment of Developing Device from Toner Bottle

Figure 2:
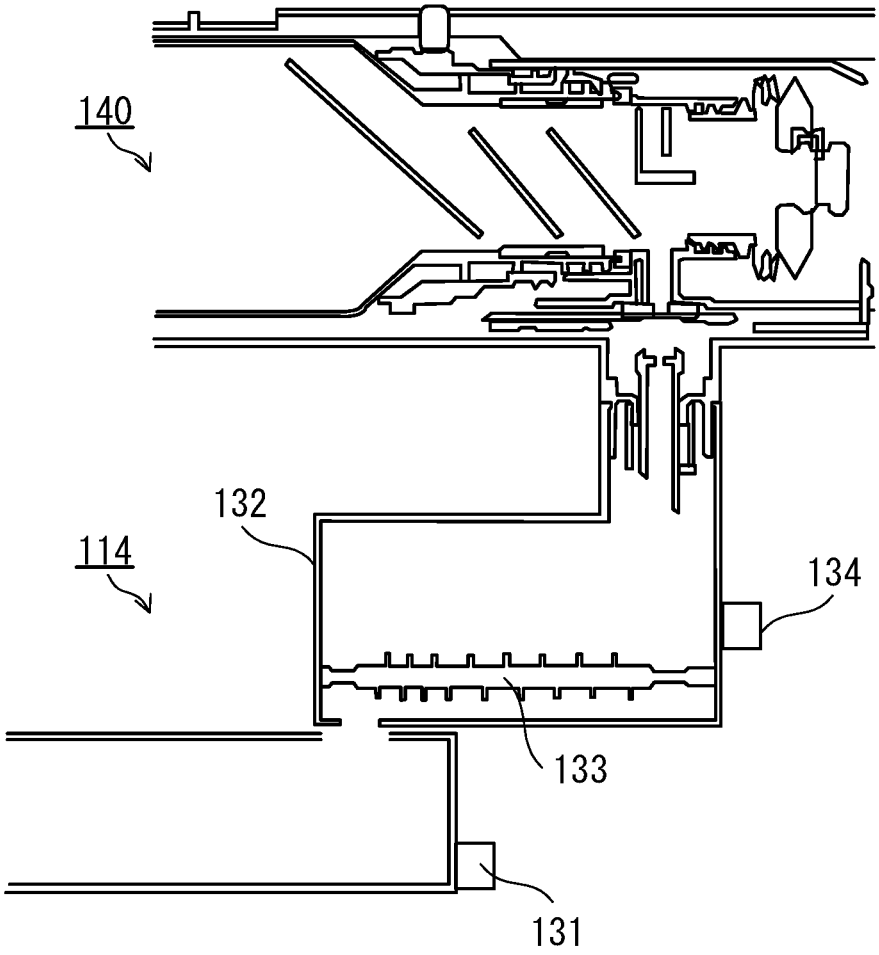
FIG. 2 is an explanatory diagram of an operation for replenishing toner.

FIG. 2 is an explanatory diagram of an operation for replenishing the developing device 114 with toner from a toner bottle 140. In the image forming process, the developing device 114 develops the electrostatic latent image with toner. The developing device 114 internally contains toner, and consumes toner being a consumable by a developing operation. This reduces the toner in the developing device 114 each time the image forming process is performed. The developing device 114 is required to be replenished with toner from the toner bottle 140 in order to compensate for the reduced toner.

The developing device 114 includes a developing toner amount detection sensor 131 configured to detect the amount of the contained toner. The developing device 114 internally communicates to the toner bottle 140 through a hopper 132. When the amount of toner in the developing device 114 detected by the developing toner amount detection sensor 131 falls below a fixed amount, the developing device 114 is replenished with toner contained in the hopper 132. The hopper 132 internally includes a replenishing screw 133. Through the control of the rotation amount of the replenishing screw 133, the amount of toner to be supplied from the hopper 132 to the developing device 114 is maintained at a fixed amount.

When the amount of toner contained in the hopper 132 becomes equal to or smaller than a predetermined amount, the developing device 114 cannot be replenished with an accurate amount of toner from the hopper 132 irrespective of the rotation amount of the replenishing screw 133. The hopper 132 includes a hopper toner amount detection sensor 134 configured to detect the amount of the contained toner. When the amount of toner in the hopper 132 detected by the hopper toner amount detection sensor 134 falls below the fixed amount, the hopper 132 is replenished with toner contained in the toner bottle 140.

As each of the developing toner amount detection sensor 131 and the hopper toner amount detection sensor 134, for example, an inductance sensor configured to measure magnetic permeability or a powder level sensor using a piezoelectric vibrator can be used, but the present disclosure is not limited thereto.

As described above, the toner bottle 140 is removably attached to the bottle mount (not shown) provided to the image forming apparatus 101. A replenishment port of the toner bottle 140 has its replenishment port shutter opened when the toner bottle 140 is mounted to the bottle mount. The toner bottle 140 has a spiral toner conveyor formed in its inside. When an instruction to replenish the hopper 132 with toner is issued, the toner bottle 140 is rotated to convey the toner toward the replenishment port by the toner conveyor. Then, the hopper 132 is replenished with the toner in the toner bottle 140 from the replenishment port of the toner bottle 140.

In this manner, the toner to be consumed by the developing device 114 is supplied from the toner bottle 140. Therefore, the toner in the toner bottle 140 decreases as the image forming process is further performed. The toner bottle 140 having a decreased amount of toner is replaced by a new toner bottle. This replacement allows the image forming apparatus 101 to continuously execute the image forming process.

Replacement of Toner Bottle

When the hopper toner amount detection sensor 134 does not detect a fixed amount of toner or more in the hopper 132 even after the operation for replenishing the toner from the toner bottle 140 to the hopper 132 is continued a predetermined number of times, the image forming apparatus 101 determines that the toner in the toner bottle 140 has run out. In this case, the image forming apparatus 101 prompts the user to replace the toner bottle 140. However, the image forming process can be continued until the developing toner amount detection sensor 131 stops detecting a fixed amount of toner or more in the developing device 114.

When the toner bottle 140 is replaced, the image forming apparatus 101 executes the operation for replenishing the toner from the toner bottle 140 to the hopper 132 until the hopper toner amount detection sensor 134 detects the fixed amount of toner or more in the hopper 132. When the amount of the toner in the developing device 114 detected by the developing toner amount detection sensor 131 falls below the fixed amount during the execution of the operation for replenishing the toner, the image forming apparatus 101 controls the replenishing screw 133 to replenish the developing device 114 with toner from the hopper 132. When the hopper toner amount detection sensor 134 detects the fixed amount of toner or more in the hopper 132, the image forming apparatus 101 stops the operation for replenishing the toner from the toner bottle 140 to the hopper 132.

Controller

Figure 3:
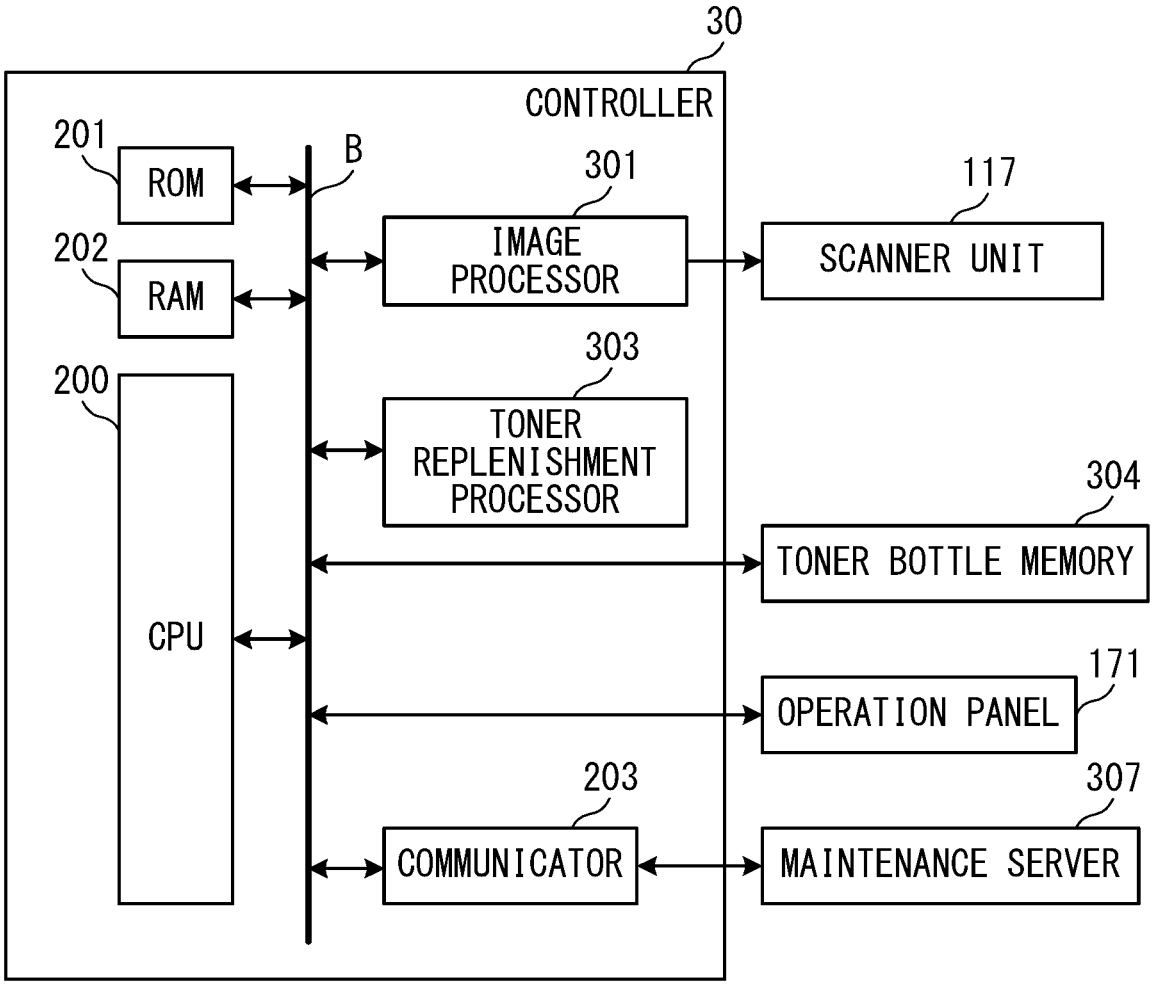
FIG. 3 is an explanatory diagram of a controller.

FIG. 3 is an explanatory diagram of a controller configured to control an operation of the image forming apparatus 101. A controller 30 performs delivery management for a consumable to be used for image formation in addition to the control of the image forming operation (conveyance process and image forming process). The controller 30 is provided inside the image forming apparatus 101. The following description is directed to a case in which the consumable is toner.

The controller 30 is connected to the scanner unit 117, a toner bottle memory 304, and an operation panel 171. The controller 30 is also connected to a maintenance server 307 through a public line or other such network so as to enable communication therebetween.

The toner bottle memory 304 is provided to the toner bottle 140, and stores remaining toner amount information indicating a remaining amount of toner contained in the toner bottle 140. When the toner bottle 140 is unused, the toner bottle memory 304 stores the amount of toner filled at the time of production as an initial value of the remaining toner amount information. The remaining toner amount information stored in the toner bottle memory 304 is managed by the controller 30 so as to be rewritable. The toner bottle memory 304 also stores information for determining whether or not the maintenance server 307 has been notified of a delivery request signal, which is described later.

The operation panel 171 is a user interface that combines an input device including a key button and a touch panel and an output device including a display. The operation panel 171 is provided to the image forming apparatus 101, transmits an instruction or other such information to the controller 30, and displays an image on the display under the control of the controller 30.

The maintenance server 307 is an external server apparatus connected to the image forming apparatus 101 through a network, and includes a display configured to perform display corresponding to a signal received from the controller 30. The maintenance server 307 is installed in a maintenance service organization operated by the distributor of the image forming apparatus 101.

The controller 30 is an information processing apparatus including a central processing unit (CPU) 200, a read only memory (ROM) 201, and a random access memory (RAM) 202. The CPU 200 controls the operation of the image forming apparatus 101 by executing a computer program stored in the ROM 201 with the RAM 202 being used as a work area. The CPU 200, the ROM 201, and the RAM 202 are connected to one another through a bus B so as to enable communication thereamong. In addition, an image processor 301, a toner replenishment processor 303, and a communicator 203 are connected to the bus B. The toner bottle memory 304 and the operation panel 171 are connected to the bus B as well.

When a print job is input from an external apparatus (not shown) or the operation panel 171, the CPU 200 transmits an instruction corresponding to a print job to the image processor 301. The image processor 301 generates image pixel information corresponding to an image to be formed. The image processor 301 generates a laser emission command corresponding to the image pixel information, and transmits the laser emission command to the scanner unit 117. The scanner unit 117 has its light emission timing controlled by the laser emission command. The image pixel information is also used for the prediction of a toner usage amount.

The CPU 200 calculates a new remaining toner amount by sequentially subtracting a predicted value of the toner usage amount calculated by a method described later from the remaining toner amount information acquired from the toner bottle memory 304. The CPU 200 updates the remaining toner amount information stored in the toner bottle memory 304 based on the newly calculated remaining toner amount. The CPU 200 notifies the maintenance server 307 of a delivery request signal for requesting a delivery of a new toner bottle through the communicator 203 at a timing determined by a method described later. The delivery request signal functions as a signal for requesting to place an order.

As described above, the toner replenishment processor 303 determines the operation timings of the replenishing screw 133 and the toner bottle 140 based on detection results obtained by the developing toner amount detection sensor 131 and the hopper toner amount detection sensor 134, and rotationally drives motors for driving the replenishing screw 133 and the toner bottle 140. The toner replenishment processor 303 counts the number of times of rotating the toner bottle 140 as a toner replenishment count, and stores the toner replenishment count in the RAM 202.

Delivery Management of Consumable

Figure 4:
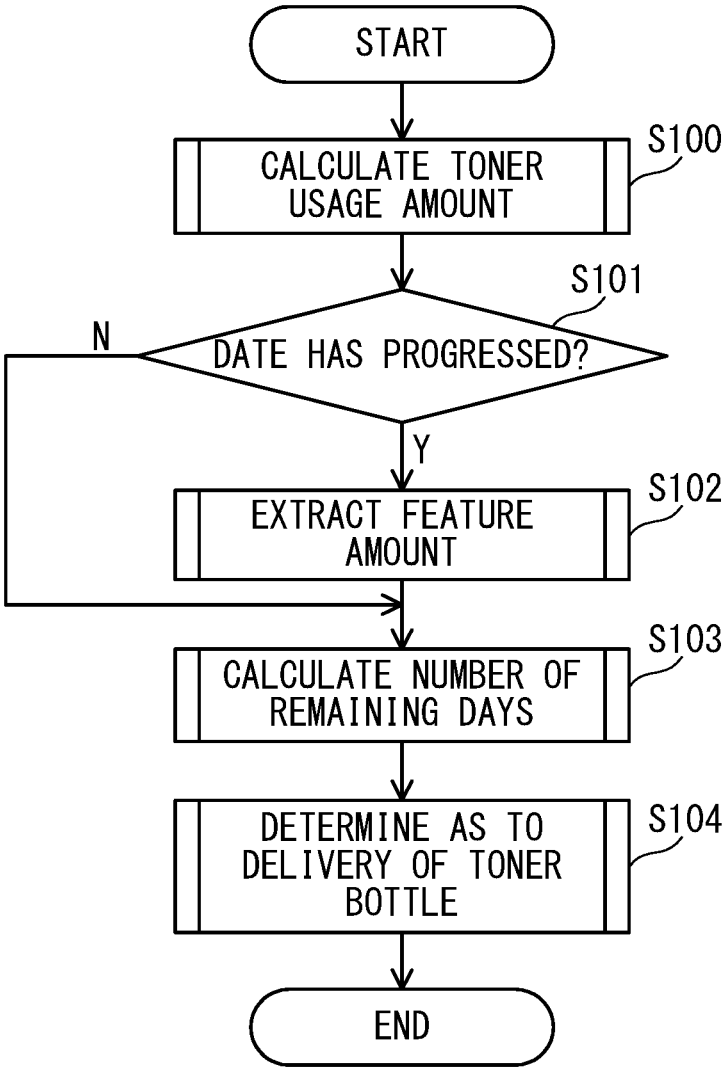
FIG. 4 is a flow chart for illustrating delivery management processing for a consumable.

Delivery management processing for a consumable to be performed by the above-mentioned image forming apparatus 101 is described. In the following description, the consumable is toner, and the delivery management of the toner bottle 140 is performed. The CPU 200 predicts the number of remaining days for which the toner can be used, and notifies the maintenance server 307 of the delivery request signal for the toner bottle based on the number of remaining days. FIG. 4 is a flow chart for illustrating such delivery management processing for the consumable. The CPU 200 performs the delivery management processing at a predetermined fixed cycle period, for example, once per second.

The CPU 200 calculates the toner usage amount based on toner replenishment information and the image pixel information (Step S100). The toner replenishment information is, for example, a toner replenishment count stored in the RAM 202, and indicates the amount of toner supplied from the toner bottle 140. Processing for predicting the toner usage amount is described later in detail.

The CPU 200 that has calculated the toner usage amount checks the date, and determines whether or not the date has progressed from the date on which the toner usage amount per day was previously acquired (Step S101). When the date has progressed (Y in Step S101), the CPU 200 calculates the average value and the standard deviation of the usage amount of the toner used by the user during a past predetermined period to extract a feature amount indicating a feature of using the image forming apparatus 101 by the user (Step S102). Feature amount extraction processing is described later in detail.

After extracting the feature amount, the CPU 200 calculates the number of remaining days of the toner in the toner bottle 140 (Step S103). When the date has not progressed (N in Step S101), the CPU 200 calculates the number of remaining days of the toner in the toner bottle 140 without extracting the feature amount (Step S103). The processing for calculating the number of remaining days is described later in detail. The CPU 200 determines whether or not to issue a notification of the delivery request signal for the toner (toner bottle 140) from the number of remaining days of the toner in the toner bottle 140 and the number of days required for the delivery of the toner bottle 140 (Step S104). Processing for determining whether or not to issue the notification of the delivery request signal is described later in detail. Then, the CPU 200 brings one time of delivery management processing to an end.

Figure 5:
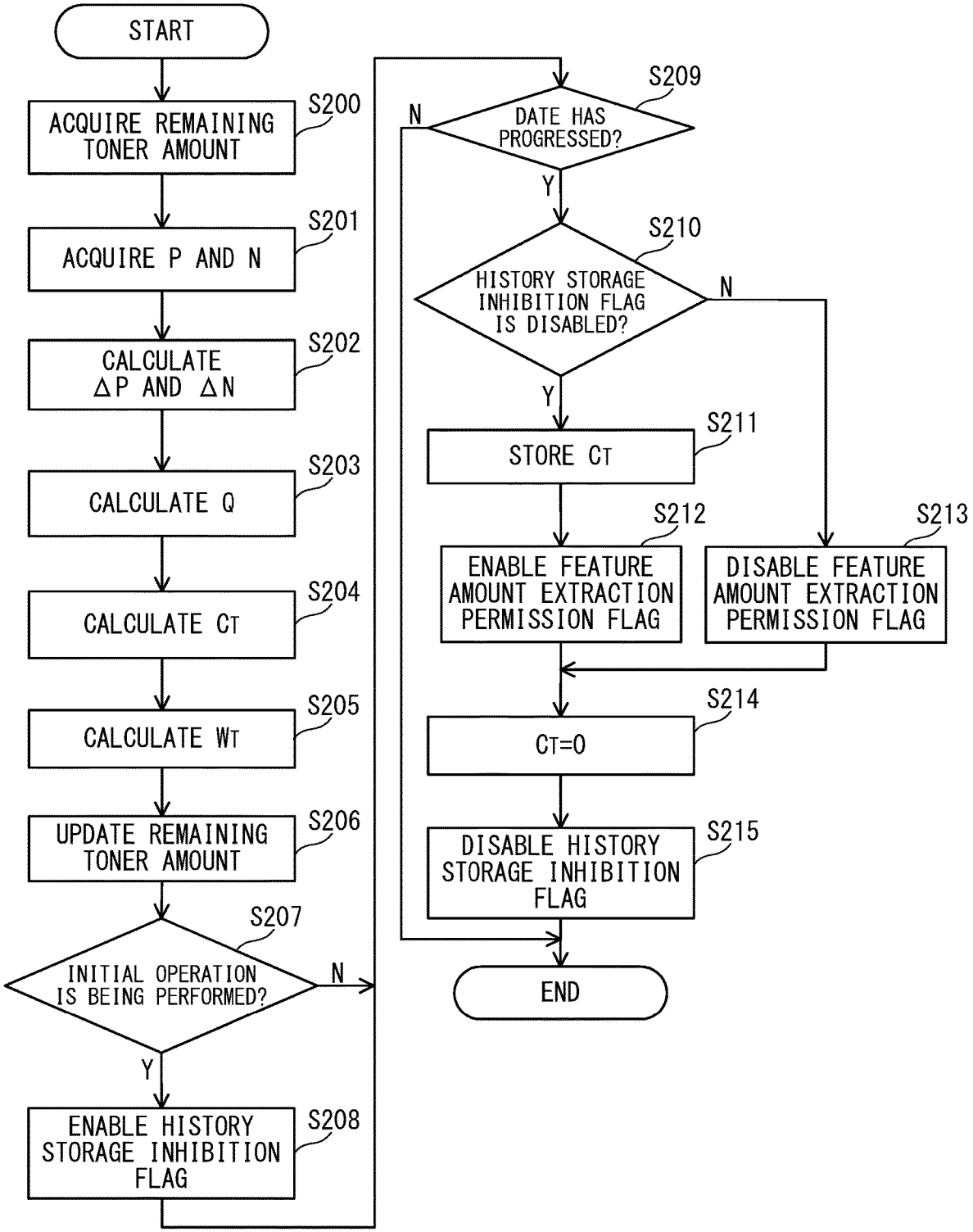
FIG. 5 is a flow chart for illustrating toner usage amount calculation processing.

FIG. 5 is a flow chart for illustrating toner usage amount calculation processing of Step S100. Now, a case in which the CPU 200 performs the toner usage amount calculation processing at the timing of a time T is described. A timing at which this processing was performed last time is a time T−1.

The CPU 200 acquires the remaining toner amount information (remaining toner amount $W_{T-1}$) on the toner bottle 140 at the time of the previous processing stored in the toner bottle memory 304 (Step S200). The remaining toner amount $W_{T-1}$ is the remaining toner amount calculated by the processing performed by the CPU 200 last time and stored in the toner bottle memory 304. The remaining toner amount is an example of remaining data on the remaining amount of the consumable. When the CPU 200 first performs the processing illustrated in FIG. 5 after the toner bottle 140 is newly attached, the remaining toner amount $W_{T-1}$ is the amount of toner filled at the time of the production of the toner bottle 140, which is the initial value.

The CPU 200 acquires image pixel information P from the image processor 301, and acquires a toner replenishment count N from the RAM 202 (Step S201). The image pixel information P represents a cumulative value of the number of pixels that have been subjected to the image formation to be output so far. The toner replenishment count N represents a cumulative value of the number of times that the toner bottle 140 has been rotated so far. The toner replenishment count N is an example of consumption data on the consumption amount of the consumable. Further, the image pixel information P is an example of the consumption data on the consumption amount of the consumable.

The CPU 200 calculates ΔP from the number of pixels indicated by the image pixel information P, and ΔP is a result of subtracting the number of pixels indicated by image pixel information PT−1 acquired in the previous processing. In addition, the CPU 200 calculates ΔN from the toner replenishment count N, and N is a result of subtracting a toner replenishment count NT−1 acquired in the previous process (Step S202).

The CPU 200 calculates an estimated amount (estimated usage amount Q) of toner per time estimated to be used at the current time T based on the calculated values of ΔP and ΔN, a representative value of a toner usage amount per pixel, and a representative value of a toner usage amount per time of toner replenishment (Step S203). The estimated usage amount Q is calculated by, for example, the following expression. The unit of the estimated usage amount Q is in milligrams.

$$Q=(0.015\times\Delta P+180\times\Delta N)/2$$

In this expression, the representative value of the toner usage amount per pixel is 0.015 mg, and the representative value of the toner usage amount per time of toner replenishment is 180 mg. This expression is a calculation expression for obtaining the estimated usage amount Q of the toner estimated to be used at the current time T through use of an average of the estimated toner usage amount based on the output image and the estimated toner usage amount based on a toner supply amount from the toner bottle 140.

Next, the CPU 200 computes the toner usage amount per day. The CPU 200 calculates a cumulative toner usage amount $C_T$ corresponding to the current day at the time T by adding the estimated usage amount Q to a cumulative toner usage amount $C_{T-1}$ corresponding to the current day obtained at the time of the previous computation (Step S204). The CPU 200 further calculates a remaining toner amount $W_T$ at the time T by subtracting the estimated usage amount Q from the remaining toner amount $W_{T-1}$ (Step S205). The CPU 200 updates the remaining toner amount information stored in the toner bottle memory 304 based on the calculated remaining toner amount $W_T$ at the time T (Step S206).

The CPU 200 determines whether or not an initial operation at the time of the replacement of the toner bottle 140 is being performed (Step S207). When the initial operation is being performed (Y in Step S207), the CPU 200 enables a history storage inhibition flag (Step S208). The history storage inhibition flag is used for determining whether or not to store the toner usage amount per day in a past usage amount list described later. The history storage inhibition flag sets whether to permit the user to store the usage history of the consumable or to inhibit the storage. The history storage inhibition flag is normally disabled. When the initial operation is not being performed (N in Step S207), the history storage inhibition flag remains disabled. After that, the CPU 200 checks the date to determine whether or not the date has progressed from a day on which the toner usage amount calculation processing was performed last time (Step S209). When the date has progressed (Y in Step S209), the CPU 200 examines the state of the history storage inhibition flag (Step S210).

When the history storage inhibition flag is disabled (Y in Step S210), the CPU 200 determines the cumulative toner usage amount $C_T$ corresponding to the current day as the toner usage amount per day, and stores the cumulative toner usage amount $C_T$ in the past usage amount list (Step S211). The past usage amount list is a list for storing a history of the toner usage amount per day, and is stored in the RAM 202. After that, the CPU 200 enables a feature amount extraction permission flag (Step S212). The feature amount extraction permission flag is a flag to be used for determining whether or not to execute the feature amount extraction processing of Step S102 illustrated in FIG. 4. When the feature amount extraction permission flag is enabled, the feature amount extraction processing is executed in Step S102 of FIG. 4.

When the history storage inhibition flag is enabled (N in Step S210), the CPU 200 disables the feature amount extraction permission flag (Step S213). When the feature amount extraction permission flag is disabled, the feature amount extraction processing is not executed in Step S102 of FIG. 4.

After setting the feature amount extraction permission flag, the CPU 200 clears the cumulative toner usage amount $C_T$ corresponding to the current day to 0 (Step S214), and disables the history storage inhibition flag to bring the processing to an end (Step S215). When the date has not progressed (N in Step S209), the CPU 200 brings the processing to an end without performing Step S210 and the subsequent processing. Therefore, this processing is brought to an end without the cumulative toner usage amount $C_T$ corresponding to the current day being reset to 0. In this case, the estimated usage amount Q calculated in the processing of Step S203 is accumulated in the cumulative toner usage amount $C_T$ corresponding to the current day at the time of the execution of the subsequent processing (processing of Step S204).

Figure 6A:
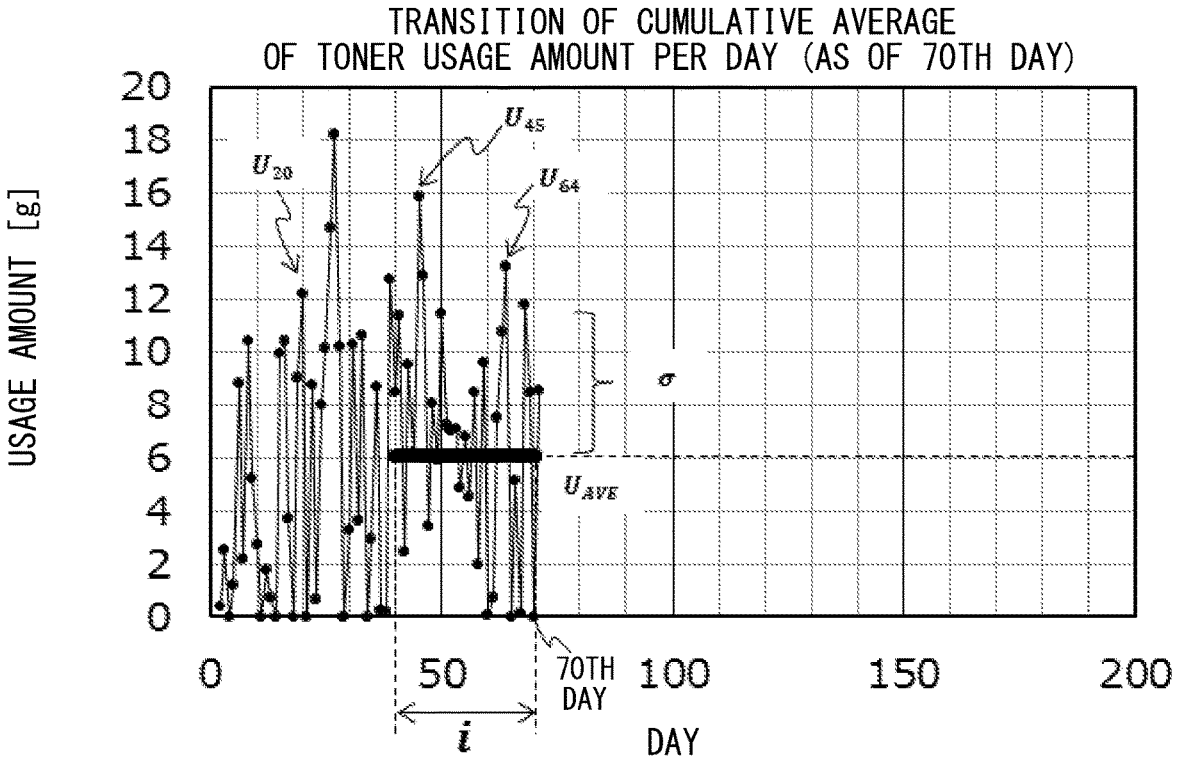
FIG. 6A is a graph for showing an example of a toner usage amount per day.
Figure 6B:
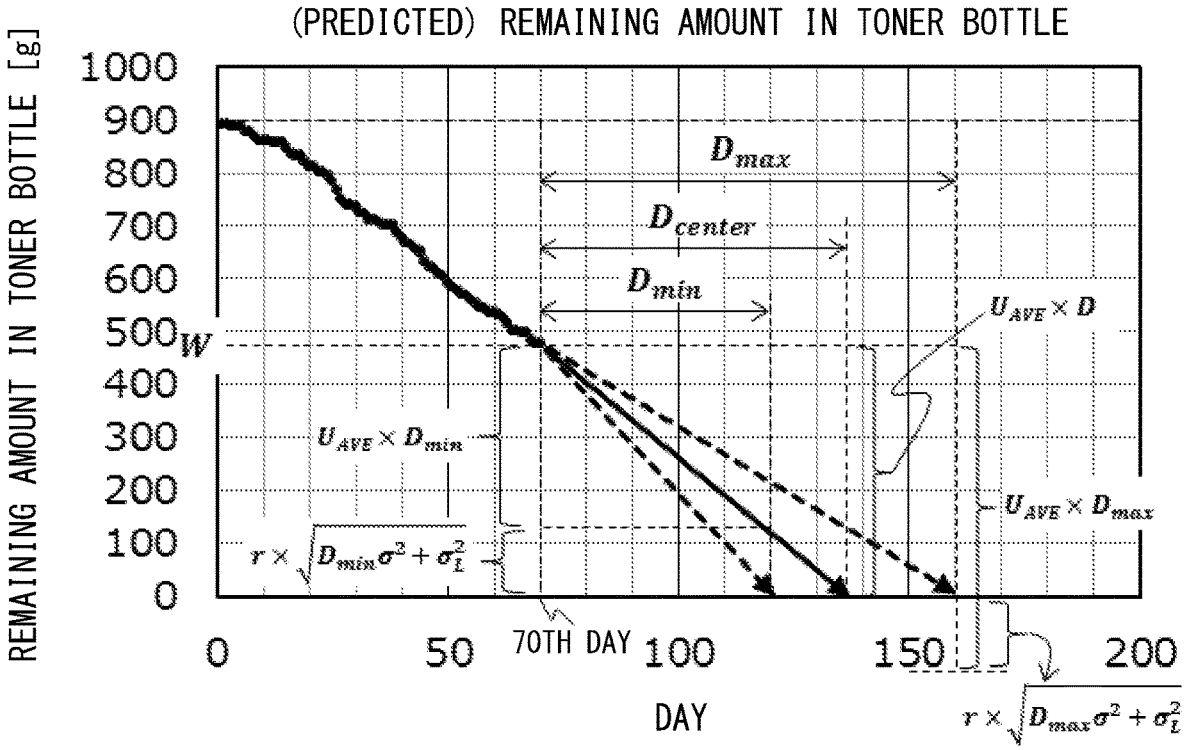
FIG. 6B is a graph for showing an example of the amount of toner remaining in a toner bottle.

FIG. 6A and FIG. 6B are graphs for showing examples of the toner usage amount per day and the amount of toner remaining in the toner bottle 140, respectively. FIG. 6A is a graph for showing a change in the toner usage amount per day (cumulative toner usage amount $C_T$) of the user. Each point indicates the toner usage amount per day for each day. In FIG. 6A, the change in amount of toner used when 70 days have passed since the start of the use of the toner is shown. FIG. 6B is a graph for showing a daily-basis transition of the remaining toner amount by subtracting the toner usage amount per day from the initial amount of toner (day 0). In FIG. 6B, the remaining toner amount exhibited when 70 days have passed is "W".

Figure 7:
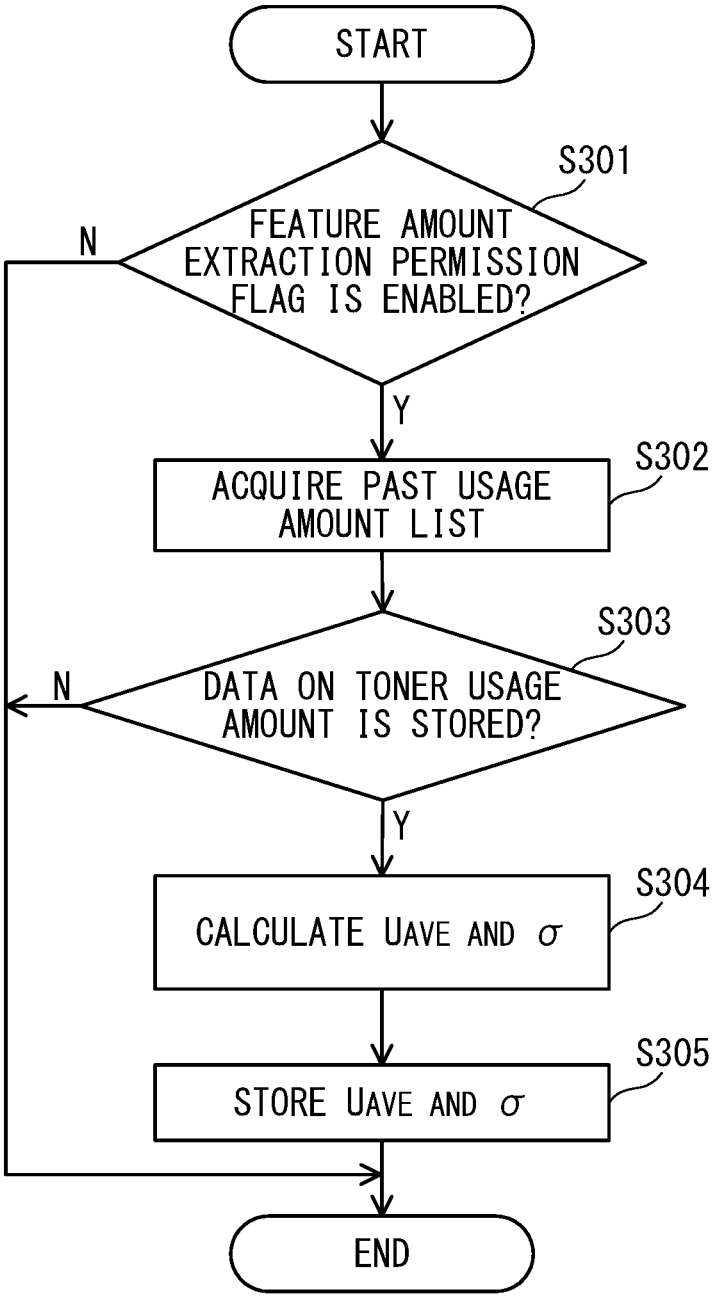
FIG. 7 is a flow chart for illustrating feature amount extraction processing.

FIG. 7 is a flow chart for illustrating the feature amount extraction processing of Step S102. The feature amount indicates a consumption tendency of the consumable exhibited when the user uses the image forming apparatus 101. In this case, as the feature amount, the average value of the toner usage amount per day and the standard deviation of the toner usage amount per day are used.

The CPU 200 examines the state of the feature amount extraction permission flag set in the processing of Step S212 and Step S213 illustrated in FIG. 5, and determines whether or not to extract the feature amount (Step S301). When the feature amount extraction permission flag is disabled (N in Step S301), the CPU 200 brings this processing to an end. In this case, the feature amount is not extracted. That is, the feature amount is not extracted while the initial operation at the time of the replacement of the toner bottle 140 is being performed.

When the feature amount extraction permission flag is enabled (Y in Step S301), the CPU 200 acquires from the RAM 202 the past usage amount list updated by the processing of Step S211 illustrated in FIG. 5 (Step S302). The CPU 200 determines whether or not data corresponding to the past predetermined period (i days) is stored in the acquired past usage amount list (Step S303). In this case, the reason for determining the presence or absence of the data corresponding to the past i days is that the toner usage amount corresponding to the past i days is required in order to predict the number of remaining days described later.

When data on the toner usage amount corresponding to the past i days is stored (Y in Step S303), the CPU 200 calculates, as the feature amount, an average value $U_{AVE}$ of a daily-basis toner usage amount corresponding to the past predetermined period and a standard deviation σ of the daily-basis toner usage amount corresponding to the past predetermined period (Step S304). Assuming that the predetermined period is i days and that the toner usage amount obtained n days before is $U_n$, the average value $U_{AVE}$ and the standard deviation σ are calculated by the following expressions. The CPU 200 stores the calculated average value $U_{AVE}$ and the calculated standard deviation σ in the RAM 202, and brings the processing to an end (Step S305). When the data on the toner usage amount corresponding to the past i days is not stored (N in Step S303), the CPU 200 brings the processing to an end without extracting the feature amount (average value $U_{AVE}$ and standard deviation σ).

$$U_{AVE} = \frac{\sum_{n=1}^{i} U_n}{i}$$

$$\sigma = \sqrt{\frac{\sum_{n=1}^{i} (U_n - U_{AVE})^2}{i-1}}$$

In at least one embodiment, the past predetermined period is set as (i days)=(30 days). This is because such an experimental result that the toner usage amount corresponding to 30 days is required in order to calculate the number of remaining days with high accuracy has been obtained. However, it is possible to freely change the number of days of the predetermined period (i days).

Figure 8:
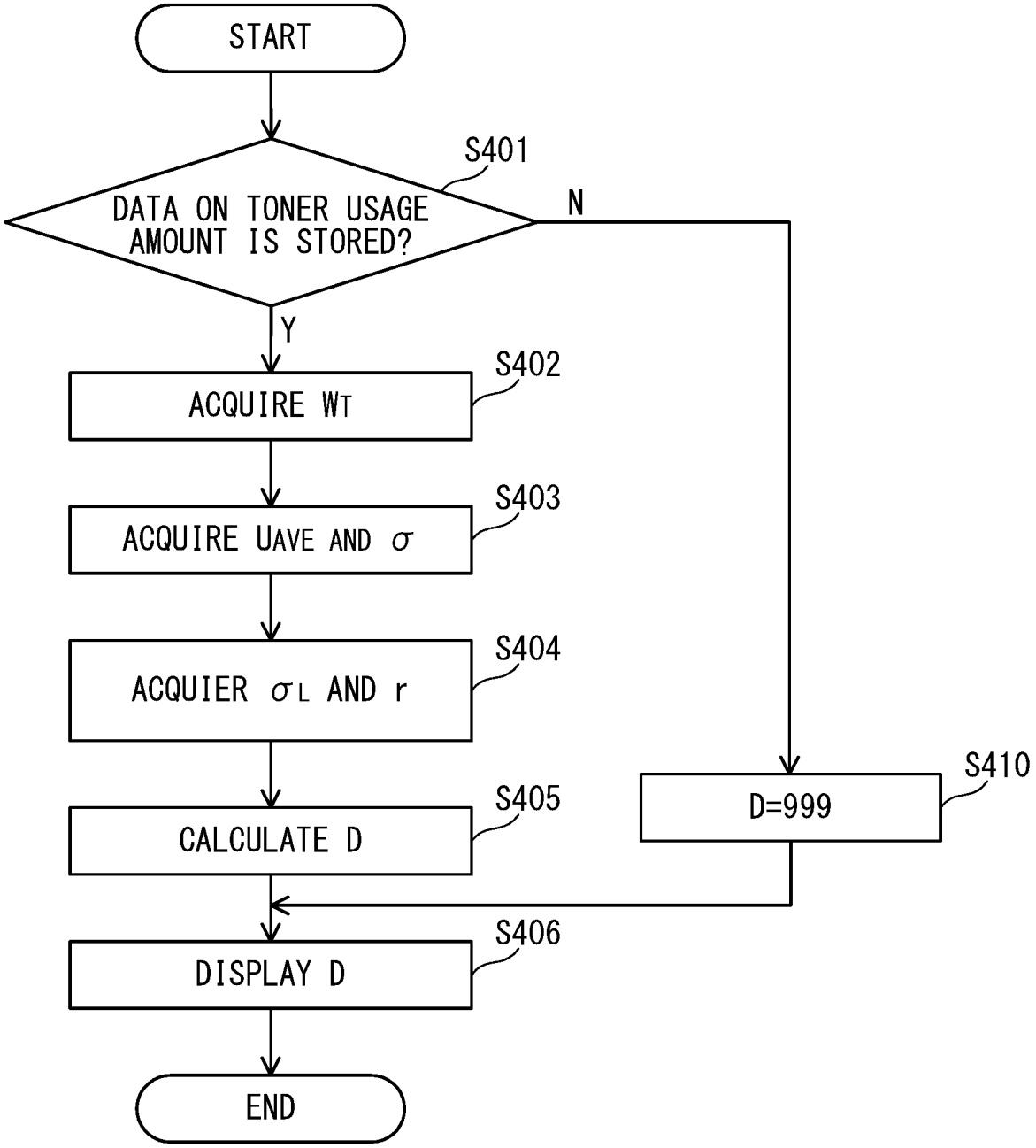
FIG. 8 is a flow chart for illustrating processing for calculating the number of remaining days.

FIG. 8 is a flow chart for illustrating the processing for calculating the number of remaining days to be performed in Step S103. The number of remaining days is an example of information relating to a replacement timing at which the consumable is to be replaced. The CPU 200 uses the data on the toner usage amount corresponding to the past predetermined period (i days) in order to predict the number of remaining days.

The CPU 200 determines whether or not the data on the toner usage amount corresponding to the past predetermined period (i days) is stored in the past usage amount list (Step S401). When the data on the toner usage amount corresponding to the past predetermined period is stored (Y in Step S401), the CPU 200 acquires the remaining toner amount $W_T$ calculated in the processing of Step S205 illustrated in FIG. 5 from the toner bottle memory 304 (Step S402). The CPU 200 acquires the average value $U_{AVE}$ and the standard deviation σ that are stored in the RAM 202 in Step S305 illustrated in FIG. 7 (Step S403). The CPU 200 acquires a remaining amount prediction error $\sigma_L$ and a delayed delivery possibility variable r, which are stored in advance in the RAM 202 (Step S404). The remaining amount prediction error $\sigma_L$ is a prediction error calculated by an experiment. The delayed delivery possibility variable r is a variable that allows the free setting of how much delay possibility is permitted. As the delayed delivery possibility variable r becomes larger, the possibility of an occurrence of a delayed delivery becomes lower, while the possibility of an early delivery becomes higher. The CPU 200 calculates a number D of remaining days until the toner bottle 140 runs out of toner based on the acquired remaining toner amount $W_T$, standard deviation σ, remaining amount prediction error $\sigma_L$, and delayed delivery possibility variable r (Step S405). A method of calculating the number D of remaining days is described later.

When the data on the toner usage amount corresponding to the past predetermined period is not stored (N in Step S401), the CPU 200 sets the number D of remaining days to a predetermined number of days, which is 999 days in at least one embodiment (Step S410). The value "999 days" is determined in advance in order to display on the operation panel 171 described later that the number of remaining days is not determined yet, and may be another value as long as it can be clarified that the number of remaining days is not determined yet.

Figure 9:
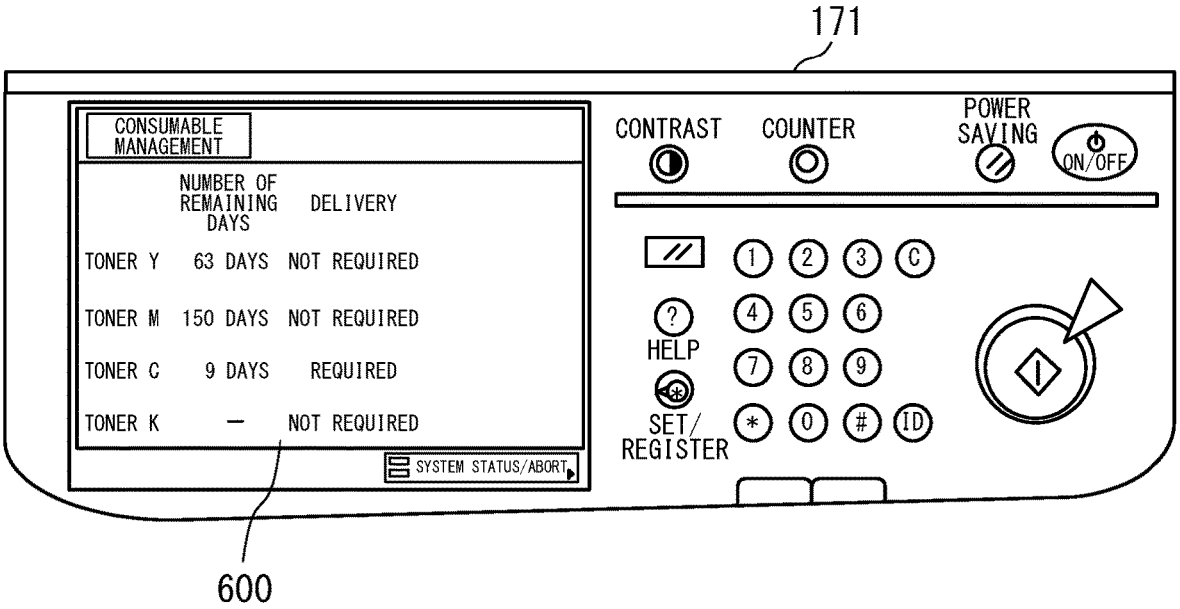
FIG. 9 is a view for illustrating an example of the number of remaining days displayed on an operation panel.

The CPU 200 displays the number D of remaining days on the display of the operation panel 171 (Step S406). FIG. 9 is a view for illustrating an example of the number D of remaining days displayed on the operation panel 171. The number D of remaining days is displayed on a consumable management screen 600 for each type of consumable. As illustrated in FIG. 9, the black toner K has no data on the toner usage amount corresponding to the past predetermined period, and the number D of remaining days is 999 days. In this case, the number of remaining days is not displayed on the consumable management screen 600, and "—" is displayed. In at least one embodiment, the number of remaining days is displayed as "—", but is only required to be distinguished from the correctly obtained number of remaining days, and may be displayed as "LEARNING" or "999 DAYS".

The method of calculating the number of remaining days to be performed in Step S405 is described in detail. The number D of remaining days is calculated on the assumption that a usage feature exhibited during the past predetermined period of i days is continued for the next D days.

The following values are used for the calculation.

Toner usage amount (center value) after D days: $U_{AVE} \times D$

Standard deviation of the toner usage amount after D days: $(\sigma^2 \times D)^{1/2}$ Prediction error of the remaining amount after D days: $\sigma_L$ Delayed delivery possibility variable: r Remaining toner amount: W From FIG. 6B, the remaining toner amount W is expressed by the following expression.

$$U_{AVE} \times D + r \times (\sigma^2 \times D)^{1/2} = W$$

From this expression, the number D of remaining days is calculated by the following expressions.

$$D = \frac{2U_{AVE}W + r^2\sigma^2 \pm \sqrt{r^4\sigma^4 + 4U_{AVE}Wr^2\sigma^2 + 4U_{AVE}^2 r^2\sigma_L^2}}{2U_{AVE}^2}$$

$$D_{min} = \frac{2U_{AVE}W + r^2\sigma^2 - \sqrt{r^4\sigma^4 + 4U_{AVE}Wr^2\sigma^2 + 4U_{AVE}^2 r^2\sigma_L^2}}{2U_{AVE}^2}$$

$$D_{max} = \frac{2U_{AVE}W + r^2\sigma^2 + \sqrt{r^4\sigma^4 + 4U_{AVE}Wr^2\sigma^2 + 4U_{AVE}^2 r^2\sigma_L^2}}{2U_{AVE}^2}$$

The CPU 200 calculates the number D of remaining days by the expressions described above. The expressions described above for calculating the number D of remaining days are an example of an estimation model for estimating a future change in remaining amount of the consumable. In this case, for the toner bottle 140 or other such consumable that may cause the image forming apparatus 101 to stop operating due to the running out, a smallest number $D_{min}$ of remaining days is employed, to thereby avoid the risk of the stop to a maximum. In addition, by adjusting the delayed delivery possibility variable r, it is possible to freely set the possibility of preventing the delayed delivery. When no feature amount is extracted in the feature amount extraction processing of Step S102, the CPU 200 cannot acquire the most recent average value $U_{AVE}$ and the most recent standard deviation σ in the processing of Step S403. In this case, the CPU 200 calculates the number D of remaining days through use of the average value $U_{AVE}$ and the standard deviation σ that were stored in the RAM 202 in the past. Therefore, when the consumable is replaced, the CPU 200 generates an estimation model without using consumption data relating to a timing at which the consumable was replaced.

Figure 10:
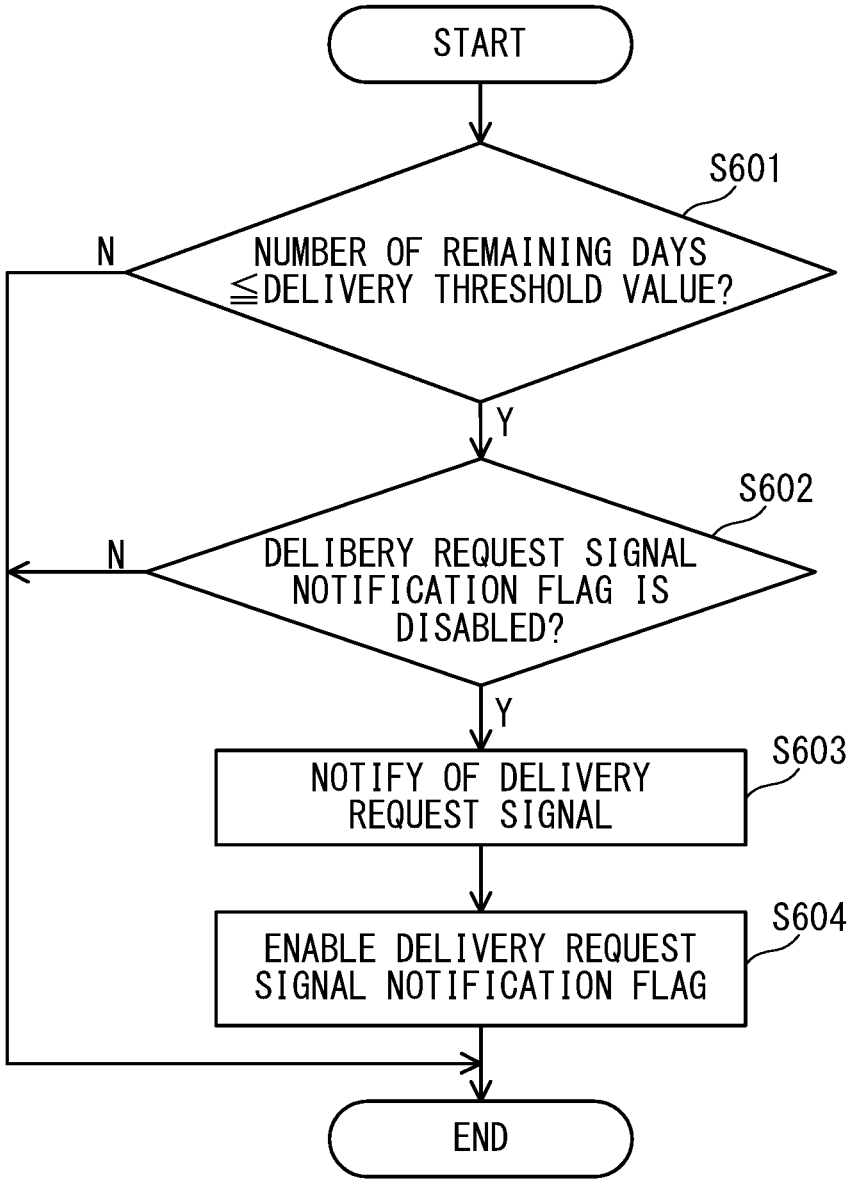
FIG. 10 is a flow chart for illustrating processing for determining whether or not to issue a notification of a delivery request signal.

FIG. 10 is a flow chart for illustrating the processing for determining whether or not to issue the notification of the delivery request signal to be performed in Step S104. The CPU 200 compares the number D of remaining days calculated in the processing of Step S405 or the processing of Step S410, which are illustrated in FIG. 8, with a predetermined delivery threshold value (Step S601). The delivery threshold value is set based on the number of days required for delivering the consumable from a delivery source to a delivery destination, and is set to 7 days in at least one embodiment. When the number D of remaining days is larger than the delivery threshold value (N in Step S601), the CPU 200 brings this processing to an end without requesting a delivery of the consumable (toner bottle 140). When the number D of remaining days is equal to or smaller than the delivery threshold value (Y in Step S601), the CPU 200 determines that the toner contained in the toner bottle 140 is soon to be used up. In this case, the CPU 200 examines a delivery request signal notification flag (Step S602). The delivery request signal notification flag indicates whether or not the delivery request signal has been notified of. When the delivery request signal notification flag is enabled (N in Step S602), the CPU 200 determines that the delivery request signal has been notified of, and therefore brings this processing to an end.

When the delivery request signal notification flag is disabled (Y in Step S602), the CPU 200 transmits a delivery request signal for the toner bottle for replacement to the operation panel 171, and also notifies the external maintenance server 307 of the delivery request signal through the communicator 203 (Step S603). The CPU 200 enables the delivery request signal notification flag, and stores the fact that the delivery request signal notification flag is enabled in the toner bottle memory 304 (Step S604). The delivery request signal notification flag is enabled so as to prevent the delivery request signal from being notified of redundantly.

When receiving the delivery request signal, the operation panel 171 displays a screen for instructing the delivery request on the display. This allows the user of the image forming apparatus 101 to arrange the delivery of the toner bottle 140 for replacement and obtain the toner bottle 140 for replacement at an appropriate timing.

The maintenance server 307 displays a screen for instructing a delivery request on a predetermined display in response to the delivery request signal acquired from the CPU 200 through the communicator 203. When the maintenance server 307 displays such a screen, an operator of the maintenance server 307 is allowed to view the displayed information to examine whether or not the delivery of a toner bottle is required to be arranged for replacement or regular stock (as well as the quantity of delivery). This allows the toner bottle for replacement to be delivered to an installation place of the image forming apparatus 101 at an appropriate timing.

Specific Example of Calculating Number of Remaining Days

A difference in number D of remaining days between a comparative example and at least one embodiment is described by taking into consideration the initial operation at the time of the replacement of the toner bottle 140.

Figure 11:
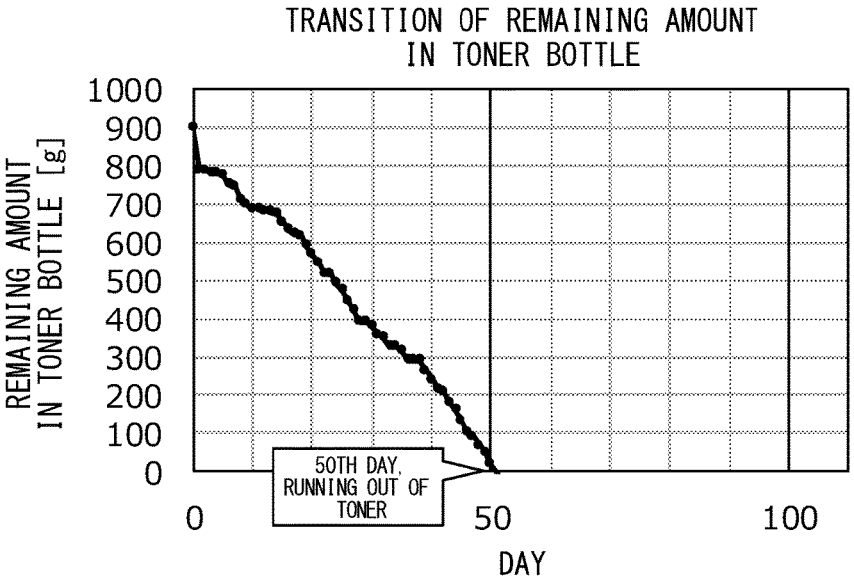
FIG. 11 is a graph for showing an example of a transition of the amount of the toner remaining in the toner bottle.

FIG. 11 is a graph for showing an example of a transition of the amount of the toner remaining in the toner bottle 140. On the first day on which the toner bottle 140 is replaced, an initial operation at the time of the replacement is performed. This increases the toner usage amount on the first day to greatly reduce the remaining toner amount. In this example, the toner in the toner bottle 140 is used up on the 50th day after the replacement.

Figure 12:
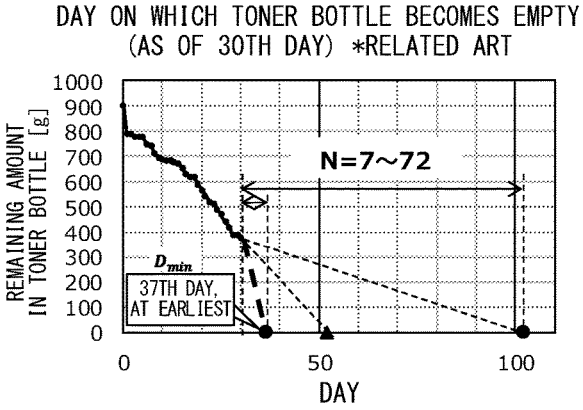
FIG. 12 is an explanatory graph and an explanatory table of the number of remaining days in a comparative example.

FIG. 12 is an explanatory graph of the number D of remaining days in the comparative example. In FIG. 12, the number D of remaining days as of the 30th day after the start of the use of the new toner bottle 140 is predicted. The remaining toner amount as of the 30th day is 378.9 g.

Hitherto, when the average value $U_{AVE}$ of the daily-basis toner usage amount corresponding to the past 30 days and the standard deviation σ of the daily-basis toner usage amount corresponding to the past 30 days are calculated, the amount of the toner used in the initial operation at the time of the replacement is included. As a result, as of the 30th day, the average value $U_{AVE}$ of the daily-basis toner usage amount corresponding to the past 30 days is 17.4 g, and the standard deviation σ of the daily-basis toner usage amount corresponding to the past 30 days is 20.6 g. Assuming that the remaining amount prediction error $\sigma_L$ is 5 g and the delayed delivery possibility variable r is 5, the smallest number $D_{min}$ of remaining days is 7 days, and a longest number $D_{max}$ of remaining days is 72 days. That is, the toner bottle 140 is predicted to be used up in the remaining 7 days (37 days from the start of the use) as the shortest possible period and in the remaining 72 days (102 days from the start of the use) as the longest possible period.

The smallest number $D_{min}$ of remaining days is equal to or smaller than the delivery threshold value, and hence the CPU 200 notifies of the delivery request signal for the toner bottle for replacement on the 30th day. The toner bottle for replacement is delivered to the user of the image forming apparatus 101 by the 37th day. However, in actuality, the remaining amount of toner in the toner bottle 140 mounted to the image forming apparatus 101 is sufficient as of the 37th day, and there are 10 days or more before the toner is used up. This leads to the early delivery of the toner bottle.

FIG. 13A and FIG. 13B are explanatory graphs of the number D of remaining days in at least one embodiment. In FIG. 13A, the number D of remaining days as of the 30th day (remaining toner amount W=378.9 g) from the start of the use of the new toner bottle 140 is predicted. In FIG. 13A, when the average value $U_{AVE}$ of the daily-basis toner usage amount corresponding to the past 30 days and the standard deviation σ of the daily-basis toner usage amount corresponding to the past 30 days are calculated, the toner usage amount on the first day including the usage amount used in the initial operation at the time of the replacement is not used. As a result, as of the 30th day, the average value $U_{AVE}$ of the daily-basis toner usage amount corresponding to the past 30 days is 14.2 g, and the standard deviation σ of the daily-basis toner usage amount corresponding to the past 30 days is 10.8 g. Assuming that the remaining amount prediction error $\sigma_L$ is 5 g and the delayed delivery possibility variable r is 5, the smallest number $D_{min}$ of remaining days is 13 days, and the longest number $D_{max}$ of remaining days is 55 days. That is, the toner bottle 140 is predicted to be used up in the remaining 13 days (43 days from the start of the use) as the shortest possible period and 55 days (85 days from the start of the use) as the longest possible period. In this manner, in at least one embodiment, the CPU 200 does not notify of the delivery request signal for the toner bottle for replacement as of the 30th day after the start of the use.

In FIG. 13B, the number D of remaining days as of the 40th day (remaining toner amount W=238.6 g) from the start of the use of the new toner bottle 140 is predicted. When the processing similar to that of FIG. 13A is performed, the smallest number $D_{min}$ of remaining days is 7 days, and the longest number $D_{max}$ of remaining days is 38 days. That is, the toner bottle 140 is predicted to be used up in the remaining 7 days (47 days from the start of the use) as the shortest possible period and 38 days (78 days from the start of the use) as the longest possible period.

The smallest number $D_{min}$ of remaining days is equal to or smaller than the delivery threshold value, and hence the CPU 200 notifies of the delivery request signal for the toner bottle for replacement on the 40th day. The toner bottle for replacement is delivered to the user of the image forming apparatus 101 by the 47th day. As of the 47th day, the remaining amount of toner in the toner bottle 140 mounted to the image forming apparatus 101 becomes smaller, and the toner is to be used up in about three days. In this manner, in at least one embodiment, the toner bottle for replacement can be delivered to the user at an optimal timing while avoiding causing the "early delivery" and the "delayed delivery".

The example based on the toner usage amount has been described above, but at least one embodiment is not limited to the toner (toner bottle), and can be applied to the recording material S or other such consumables. In addition, in at least one embodiment, the average value and the standard deviation of the usage amount are used as the feature amount of the consumable, but a dispersion value obtained by squaring the standard deviation may be used as the feature amount instead of the standard deviation.

Maintenance Mode

The image forming apparatus 101 is maintained by, for example, a service engineer in order to keep its state optimal. The image forming apparatus 101 is maintained by being operated in a maintenance mode. In the maintenance mode, the service engineer issues an instruction for adjustment for maintenance, an instruction for test printing, or other such instruction from a screen for a service engineer. The maintenance mode is irrelevant to the use by the user, and hence the accuracy of the number of remaining days deteriorates when the usage amount of the consumable exhibited by a maintenance operation is accumulated as the user's usage history. The following description is directed to the method of calculating the number of remaining days when the consumable is consumed in the maintenance mode.

The maintenance mode is set by the service engineer operating the operation panel 171. In the maintenance mode, it is possible to perform an adjustment operation for the image forming apparatus 101 and test printing. In the adjustment operation for the image forming apparatus 101, the image forming units 110 and the intermediate transfer belt unit 102 are driven. In the adjustment operation, a cleaning operation for removing stains adhering to the surfaces of the photosensitive member 111 and the intermediate transfer belt 1, an image adjustment operation for adjusting a parameter to be used for image formation by forming a toner image for image adjustment, and other such operations are performed. In the test printing, a predetermined image is formed on the recording material S, to thereby examine the normal operation of the image forming apparatus 101.

When the service engineer instructs the execution of the adjustment operation through the operation panel 171, an instruction to execute the adjustment operation is transmitted from the operation panel 171 to the CPU 200. When the service engineer instructs the execution of the test printing through the operation panel 171, a print job and information identifying that the print job is a job for test printing are transmitted from the operation panel 171 to the CPU 200. The CPU 200 can determine whether the current operation is an operation for the maintenance mode based on the instruction, the print job, and the information transmitted from the operation panel 171.

Figure 14:
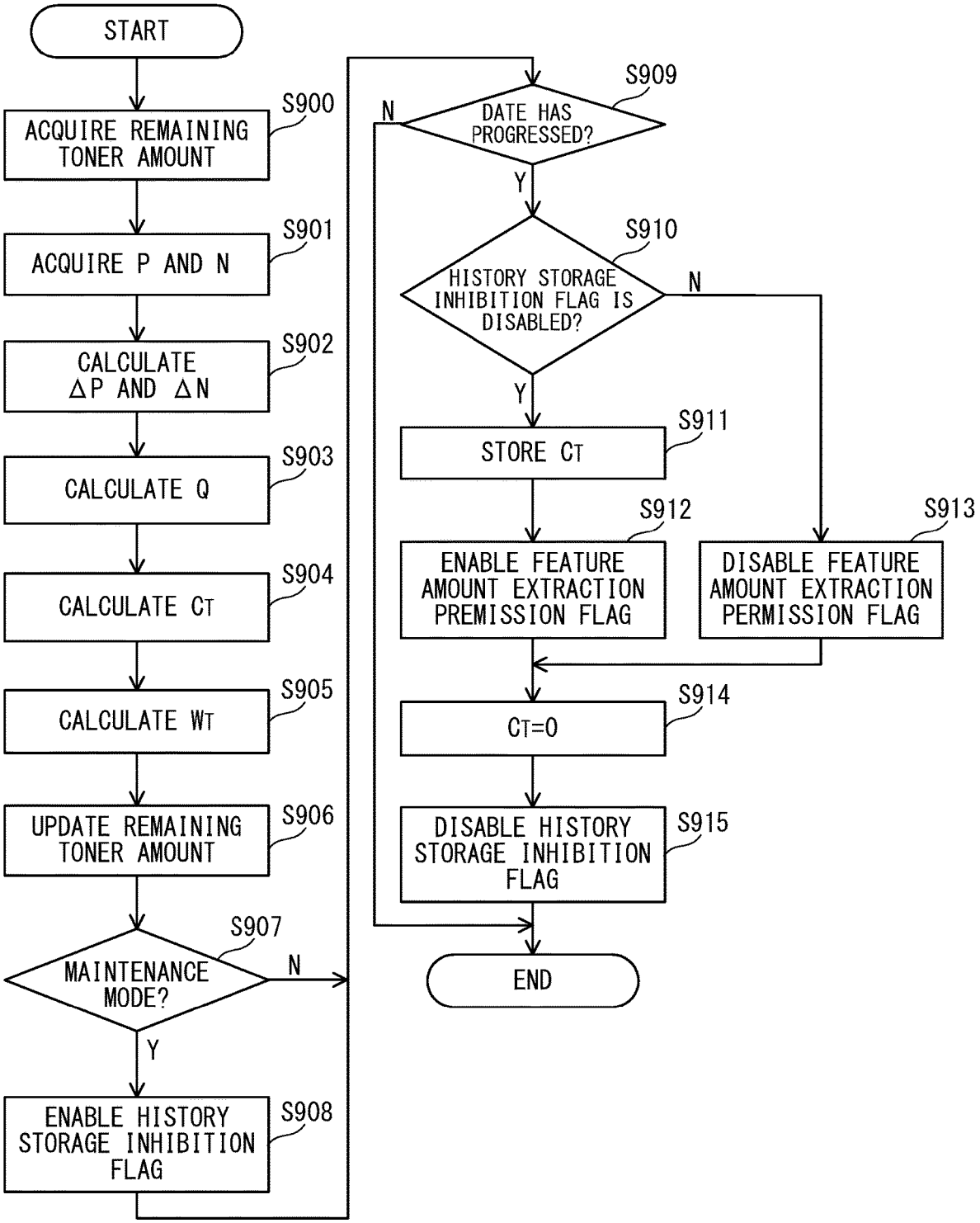
FIG. 14 is a flow chart for illustrating toner usage amount calculation processing in a maintenance mode.

FIG. 14 is a flow chart for illustrating processing for calculating the usage amount (toner usage amount) when the consumable (toner) is consumed in the maintenance mode. The CPU 200 acquires the cumulative toner usage amount $C_T$ and the remaining toner amount $W_T$ by the same processing as the processing of from Step S200 to Step S206 illustrated in FIG. 5 (Step S900 to Step S906). The CPU 200 determines whether the image forming apparatus 101 is operating in the maintenance mode (Step S907). When the image forming apparatus 101 is operating in the maintenance mode (Y in Step S907), the CPU 200 enables the history storage inhibition flag (Step S908). In this case, when the history storage inhibition flag is enabled, the CPU 200 is generating an estimation model without using the consumption data relating to a timing at which the maintenance operation was executed. When the image forming apparatus 101 is not operating in the maintenance mode (N in Step S907), the history storage inhibition flag remains disabled. After that, the CPU 200 calculates the toner usage amount by the same processing as the processing of from Step S209 to Step S215 in FIG. 5 (Step S909 to Step S915). When the image forming apparatus 101 is not operating in the maintenance mode, the CPU 200 disables the feature amount extraction permission flag without enabling the history storage inhibition flag (Step S913), and clears the cumulative toner usage amount $C_T$ to 0 (Step S214).

After that, the CPU 200 extracts the feature amount and computes the number of remaining days, to thereby be able to leave only the usage amount exhibited by the user in the history even when the consumable is used for maintenance. It is thus possible to increase the computation accuracy of the number of remaining days.

The various numerical values used in the above description are merely examples, and the present disclosure is not limited to the above-mentioned numerical values. In addition, the present disclosure can be applied to not only the image forming apparatus 101 but also any apparatus configured to operate through use of a consumable. In this manner, the image forming apparatus 101 can accurately estimate the number of remaining days, which is the number of remaining days for which the consumable can be used, and can issue a delivery request for a spare consumable at an appropriate timing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-239880, filed Dec. 21, 2018 which is hereby incorporated by reference herein in its entirety.

What is claimed is:

1. An information processing apparatus comprising:

a memory;

a controller configured to:

obtain first consumption data relating to a consumption amount of toner in an image forming apparatus at every first predetermined period;

store the first consumption data in the memory;

generate a characteristic of the consumption amount of toner in the image forming apparatus based on second consumption data consisting of the first consumption data for a second predetermined period stored in the memory, the second predetermined period being longer than the first predetermined period;

obtaining remaining data relating to a remaining toner amount in a toner container mounted to the image forming apparatus;

determine a remaining number of days until the toner container needs to be replaced based on the characteristic and the remaining data; and output a delivery request for the toner container based on the remaining number of days, wherein the controller generates the characteristic without using the first consumption data of the first predetermined period which includes a timing at which the toner container is replaced.

2. The information processing apparatus according to claim 1, wherein the controller outputs information relating to the remaining number of days on a display.

3. The information processing apparatus according to claim 1, wherein the image forming apparatus executes a maintenance operation in which the image forming apparatus forms a test image using toner.

4. The information processing apparatus according to claim 1, wherein the characteristic includes an average of the consumption amount and a standard deviation of the consumption amount.

5. A control method for an image forming apparatus that forms an image by using toner, the control method comprising:

obtaining first consumption data relating to a consumption amount of the toner in an image forming apparatus at every first predetermined period;

generating a characteristic of the consumption amount of toner in the image forming apparatus based on second consumption data consisting of the first consumption data for a second predetermined period, the second predetermined period being longer than the first predetermined period;

obtaining remaining data relating to a remaining toner amount in a toner container mounted to the image forming apparatus;

determining a number of remaining days until the toner container needs to be replaced based on the characteristic and the remaining data; and outputting a delivery request for the toner container based on the number of remaining days, wherein, in the generating, the characteristic is generated without using the first consumption data of the first predetermined period which includes a timing at which the toner container is replaced.

6. The control method for an image forming apparatus according to claim 5, further comprising displaying information relating to the remaining number of days on a display.

* * * * *